US007237805B2

(12) United States Patent
Fasan et al.

(10) Patent No.: US 7,237,805 B2
(45) Date of Patent: Jul. 3, 2007

(54) REPORT COVER

(75) Inventors: James A. Fasan, 245 James Avenue, Newmarket, Ontario (CA) L3Y 4R9; Robert G. Dickie, Newmarket (CA)

(73) Assignee: James A. Fasan, Newmarket, Ontario (CA)

( * ) Notice: Subject to any disclaimer, the term of this patent is extended or adjusted under 35 U.S.C. 154(b) by 0 days.

(21) Appl. No.: 10/985,277

(22) Filed: Nov. 10, 2004

(65) Prior Publication Data

US 2006/0097509 A1 May 11, 2006

(51) Int. Cl.
*B42D 3/00* (2006.01)

(52) U.S. Cl. ..... 281/29; 281/21.1; 281/36; 281/45; 402/502; 402/75

(58) Field of Classification Search ..... 281/29, 281/21.1, 23, 22, 36, 38, 46, 45, 42–43; 402/502, 402/14, 60, 73, 75
See application file for complete search history.

(56) References Cited

U.S. PATENT DOCUMENTS 1,495,953 A * 5/1924 Dick ..... 281/31
1,526,533 A * 2/1925 Prosper D Eggis ..... 281/23
2,599,768 A * 6/1952 Losch, Jr. ..... 402/79
3,467,479 A * 9/1969 Holes et al. ..... 402/13
3,485,564 A * 12/1969 Holes et al. ..... 402/13
4,979,626 A * 12/1990 Pitts ..... 211/45
5,236,226 A * 8/1993 Sheffield ..... 281/48
5,330,281 A * 7/1994 Kalan ..... 402/73
5,593,184 A * 1/1997 Dengler ..... 281/43
5,676,482 A * 10/1997 Hawkins ..... 402/79
5,765,873 A * 6/1998 Chen ..... 281/45
5,810,498 A * 9/1998 Hirai ..... 402/18
5,944,353 A * 8/1999 Sato ..... 281/29
5,967,689 A * 10/1999 Fleischauer ..... 402/70
6,139,209 A * 10/2000 Nicol ..... 402/7
6,209,778 B1 * 4/2001 Henrikson et al. ..... 229/67.1
6,382,864 B1 * 5/2002 Moor ..... 402/79
6,695,519 B2 * 2/2004 Tims et al. ..... 402/73

* cited by examiner

*Primary Examiner*—Monica Carter
*Assistant Examiner*—J Williams
(74) *Attorney, Agent, or Firm*—Sand + Sebolt

(57) ABSTRACT

A report cover, which can secure papers therein and may itself be secured into a ring binder. The interior portion of the spine, which lies between the front and back pages of the cover, includes a securing device for loose papers. The securing device can be cooperating pronged fasteners and apertures, clamps or clasps. The exterior portion of the spine includes a plurality of apertures, which are spaced apart from each other. The distance between the apertures is adapted to be complementary to the spacing between the prongs of a ring binder, more specifically prongs of a three-ring binder. The apertures in the spine may be formed within the exterior portion of the spine or may be offset therefrom, by spring clips, which are movably attached to the exterior portion of the spine. The apertures in the exterior portion of the spine receive the prongs of the ring binder.

21 Claims, 17 Drawing Sheets

REPORT COVER

BACKGROUND OF THE INVENTION

1. Technical Field

This invention generally relates to report covers. More particularly, the invention relates to flexible report cover into which loose pieces of paper may be filed. Specifically, the invention relates to a report cover which has a spine that both allow papers to be secured within the cover and allows the cover to be secured into a ring binder.

2. Background Information

It is common for school students to use inexpensive paperboard report covers to store and protect their worksheets and writing paper. These report covers typically comprise a folder which has an internal central spine which includes two-prong fasteners for securing papers therein. The student secures their three-hole punched papers into the report cover by inserting the prongs of the fasteners through the holes in the paper and then through apertures in the spine of the cover. The prongs are separated from each other and pushed into abutting contact with the spine of the cover. The report covers may also include pockets on the insides of the cover for holding loose sheets of paper. Alternatively, the student may use report covers which include Duo-Tang® fasteners, three prong metal fasteners or clamp type fasteners. Students may alternatively store their worksheets inside report covers which only have two pockets in the interior. Some of these two pocket report covers may have three holes punched in the cover to allow the report cover to be secured within a three-ring binder. These report covers, however, do not provide any mechanism for securing loose papers into the covers.

The student typically needs several report covers, using one report cover for each school subject. These report covers are carried around in the student's school bag and, because the covers are typically manufactured from an inexpensive, lightweight material, they tend to get easily damaged and crumpled. The covers therefore fail to serve their purpose as a protective storage device. Furthermore, the student may confuse one report cover with another and consequently bring incorrect papers to a particular class or may lose the entire report cover and its contents.

In order to address this problem, students may alternatively use hardcovered ring binders as a protective storage device for their papers and worksheets. However, in order to separate papers for different subjects, a series of dividers has to be used. This allows the student to store all of their materials, but if they need to remove all of the papers for one subject from the binder, the papers are then simply loose sheets that may become disorganized, lost or damaged.

Alternatively, students may use bound notebooks to ensure that their notes are both secure and protected. These notebooks do not, however, address the need for students to insert loose worksheets, maps or other papers into their notes relating to a particular subject.

There is therefore a need in the art for an inexpensive report cover which allows students to maintain all of their papers relating to one subject therein, but which can also be centrally organized and protected.

SUMMARY OF THE INVENTION

The present invention is a report cover which has a spine which enables loose papers to be secured into the cover and which also allows the cover to be secured into a ring binder. A plurality of report covers may therefore be secured within a ring binder with each of the report covers being adapted to secure loose papers relating to a different subject. The exterior portion of the spine includes a plurality of apertures which are spaced apart from each other. The distance between the apertures is complementary to the spacing between the prongs of a ring binder and more specifically to a three-ring binder. The apertures in the spine may be formed within the exterior portion of the spine or may be offset therefrom. The offset apertures are formed by spring clips which are movably attached to the exterior portion of the spine.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
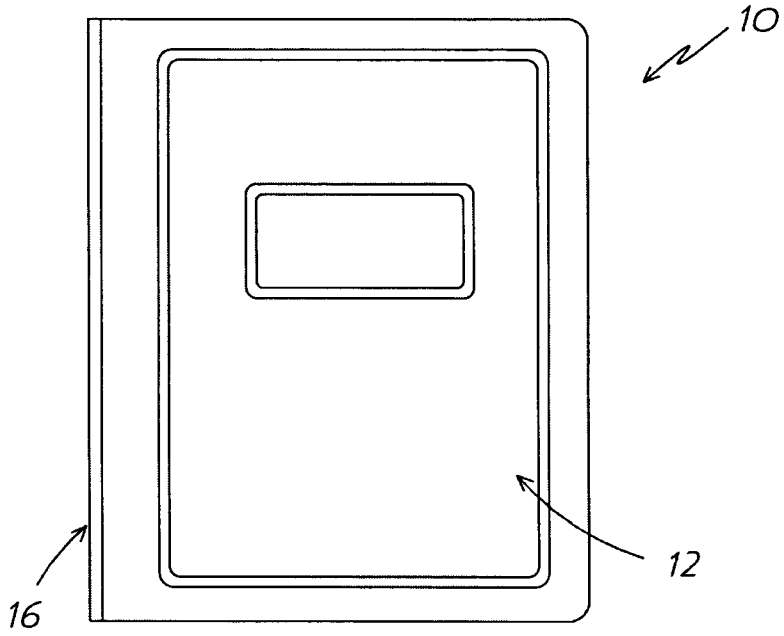
Fig. 1. PRIOR ART
FIG. 1 is a front view of a prior art report cover showing the cover in a closed position.
Figure 2:
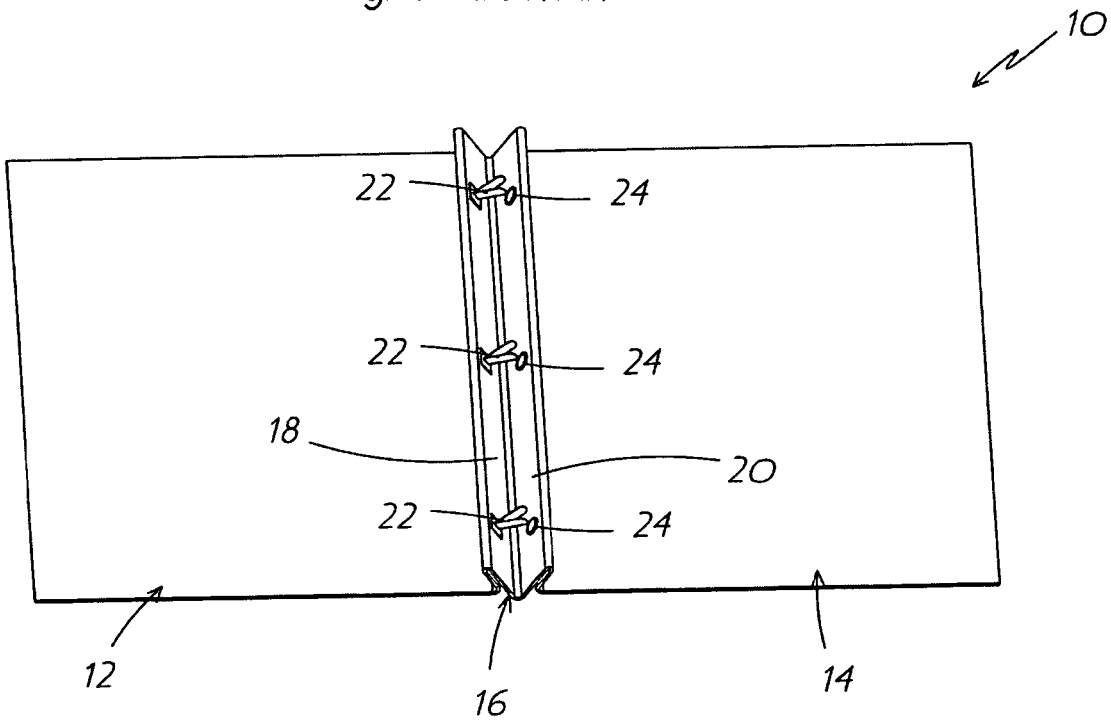
Fig. 2. PRIOR ART
FIG. 2 is a front view of the report cover of FIG. 1 showing the cover in an open position.
Figure 3:
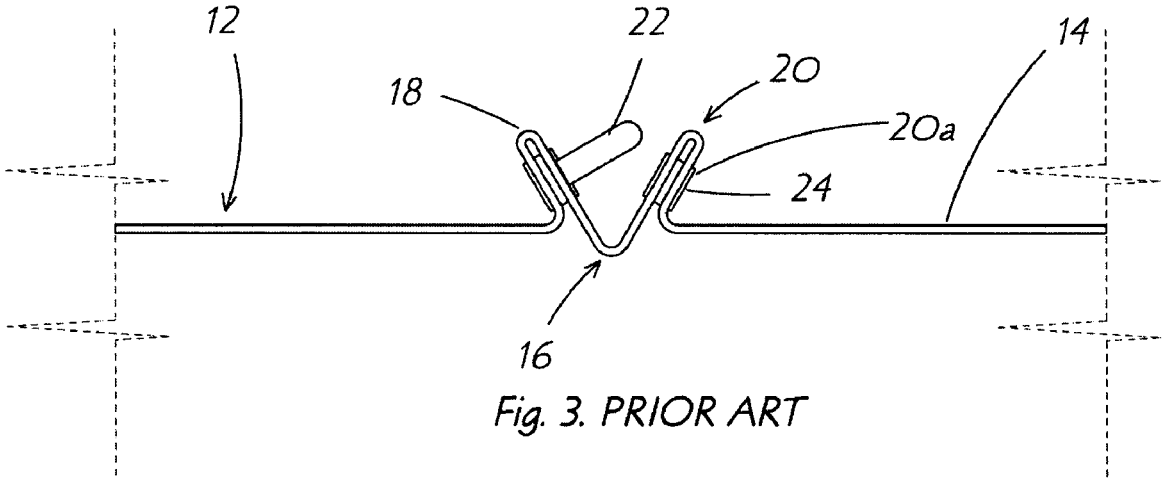
Fig. 3. PRIOR ART
FIG. 3 is a partial bottom view of the report cover of FIG. 2 showing the interior central spine and prong fasteners for attachment of papers therein.

Referring to FIGS. 1-3 there is shown the previously known type of report cover, generally indicated at 10. Cover 10 includes a front sheet 12 and a back sheet 14 joined together at a spine 16. Spine 16 includes a first section 18 and a second section 20 which extend into the interior of cover 10. First section 18 has a plurality of two-pronged fasteners 22 and second section 20 has a plurality of corresponding apertures 24. A sheet of three-hole punched paper (not shown) can be secured into report cover 10 by inserting the prongs of fasteners 22 through holes in the paper and then into apertures 24. The prongs 22 are then opened up to lie flat against the side 20*a* of second section 20.

Figure 4:
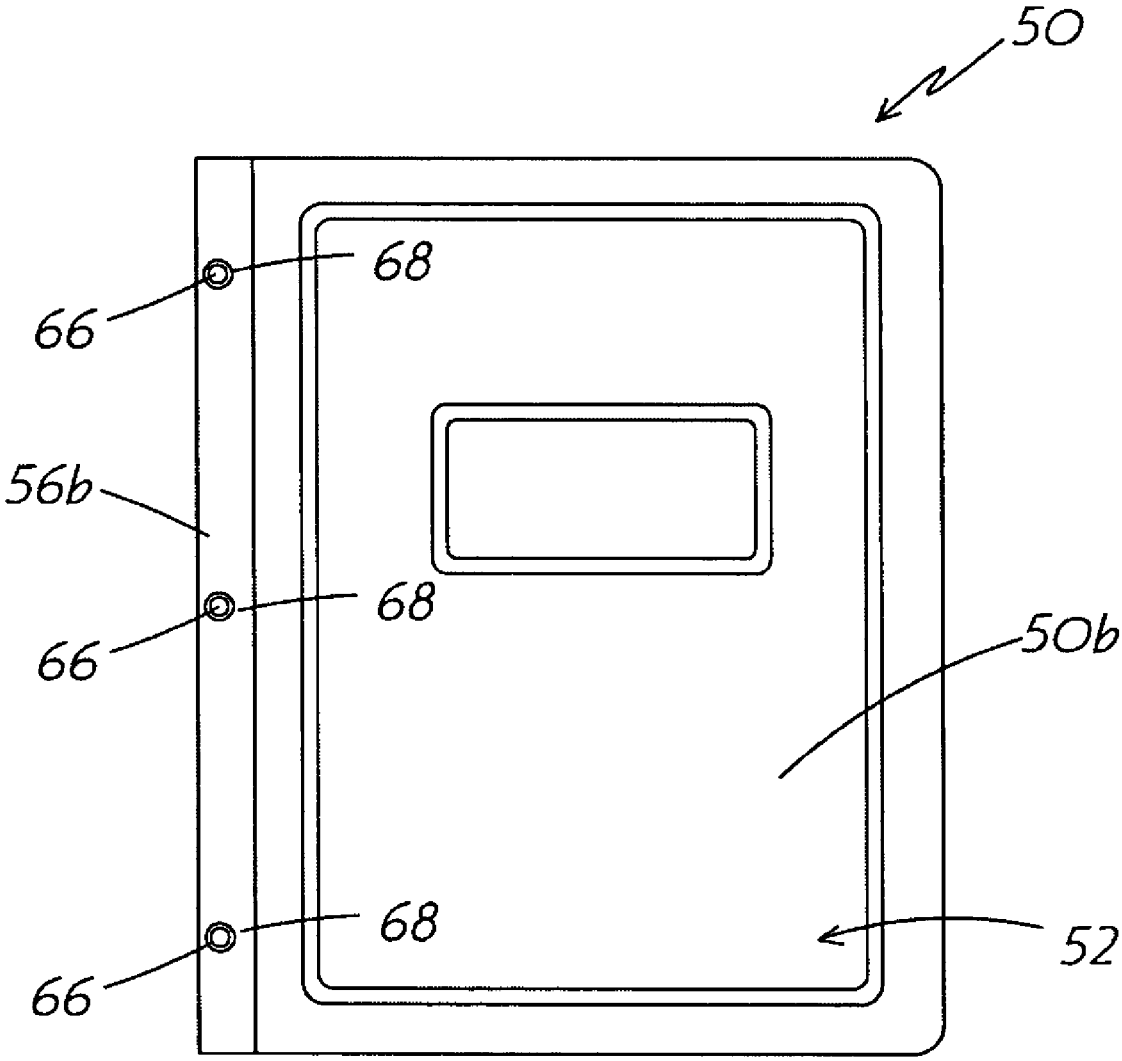
FIG. 4 is front view of a first embodiment of the report cover in accordance with the present invention; and showing the report cover in a close position.
Figure 5:
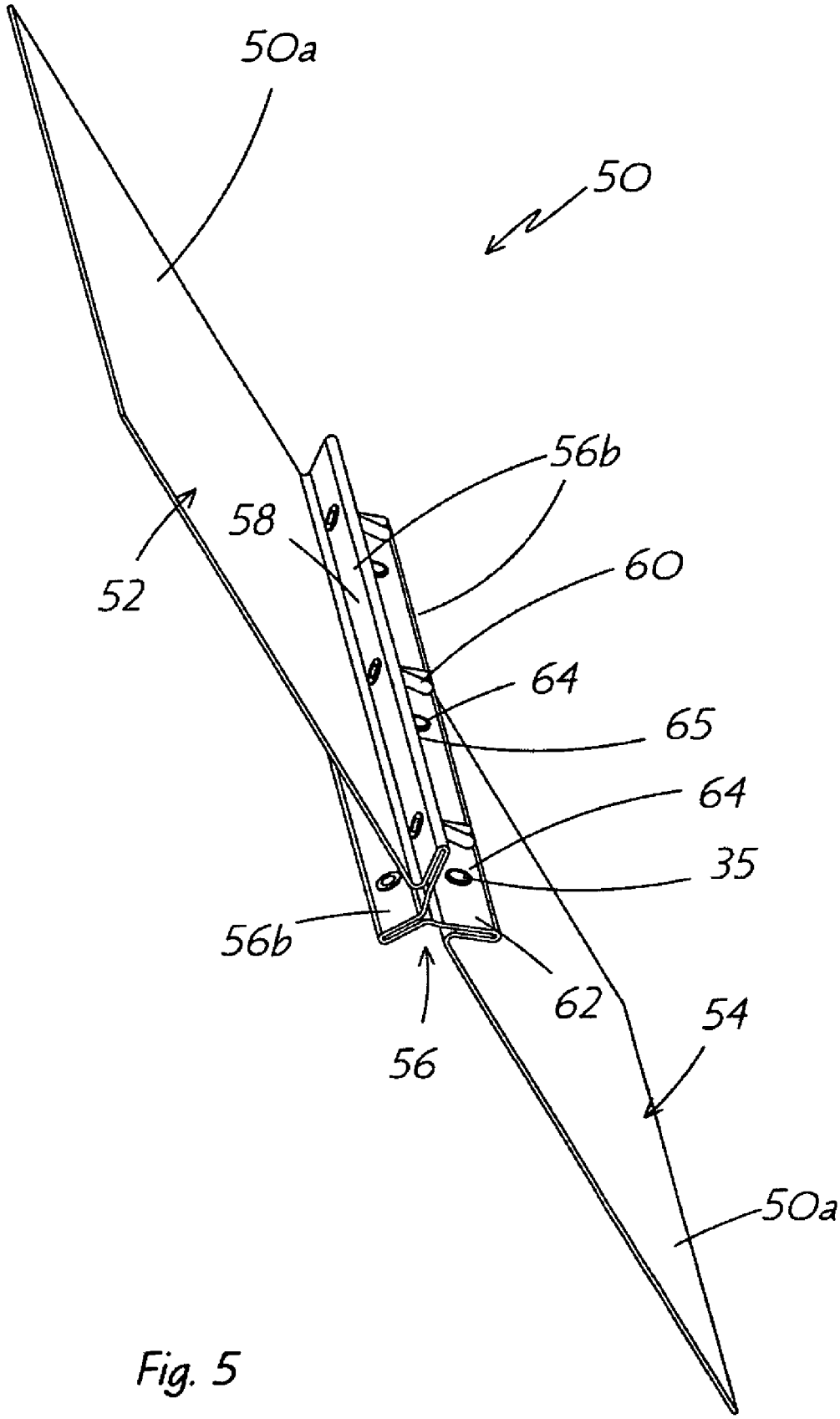
FIG. 5 is a perspective view of the report cover of FIG. 4 showing the cover in an open position.
Figure 6:
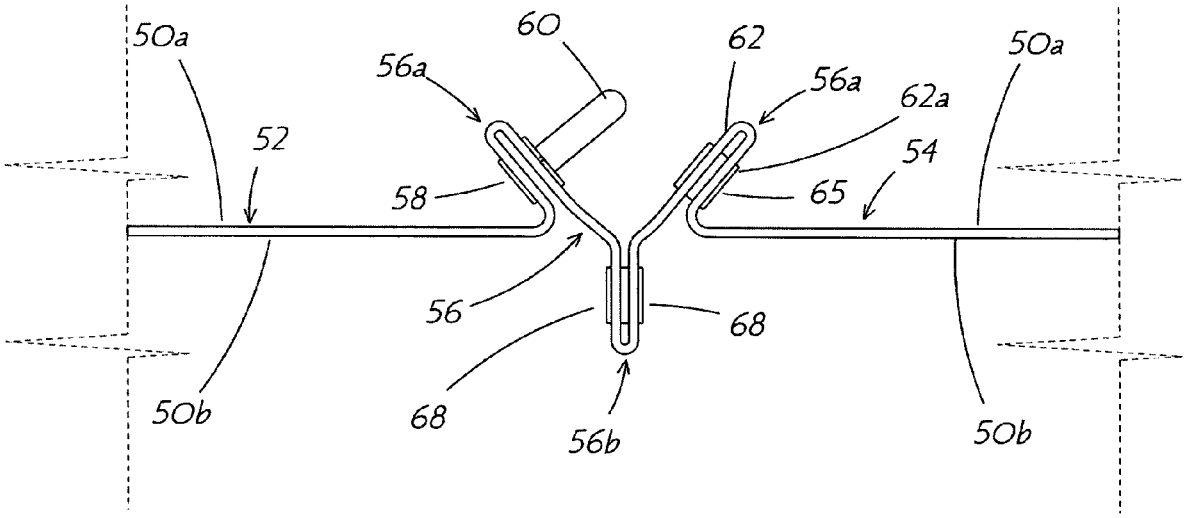
FIG. 6 is a partial bottom view of the report cover of FIG. 4, showing both the interior and exterior central spine.

Referring to FIGS. 4-6, there is shown a first embodiment of a report cover in accordance with the present invention, and generally indicated at 50. Report cover 50 comprises a front sheet 52 and a back sheet 54 joined together at a spine 56. Cover 50 has an inner surface 50*a* and an outer surface 50*b*. Spine 56 includes an interior portion 56*a* which extends outwardly from the inner surface 50*a* of cover 50. Interior portion 56*a* of spine 56 has a first section 58 with a plurality of two-pronged fasteners 60 extending therefrom and a second section 62 with a plurality of corresponding apertures 64 formed therein. Apertures 64 preferably also include a reinforcing ring 65 disposed thereabout. A sheet of three-hole punched paper (not shown) may be secured into report cover 50 by inserting the prongs of fasteners 60 through holes in the paper and then through apertures 64. Apertures 64 may be reinforced as is common in the art. The prongs are then opened up to lie flat against the side 62*a* of second section 62.

In accordance with one of the specific features of the present invention, spine 56 also includes an exterior portion 56*b* which extends outwardly from the outer surface 50*b* of cover 50 (FIGS. 1 & 6). Exterior portion 56*b* of spine 56 includes a plurality of apertures 66 therein. Apertures 66 are spaced and configured to engage the prongs of a three-ring binder as will be described hereinafter. As may be most clearly seen in FIG. 6, apertures are circumscribed by a reinforcement 68. Exterior portion 56*b* of spine 56 preferably is formed from at least one fold of paper which consequently forms a spine 56 having two layers of material with aligned apertures 66 therein. Reinforcement 68 is applied around apertures 66 in such a manner that both layers of material are connected together and do not separate from each other when cover 50 is opened. A suitable reinforcement 68 would be a metal grommet or a paper or fiber ring surrounding apertures 66.

Figure 7:
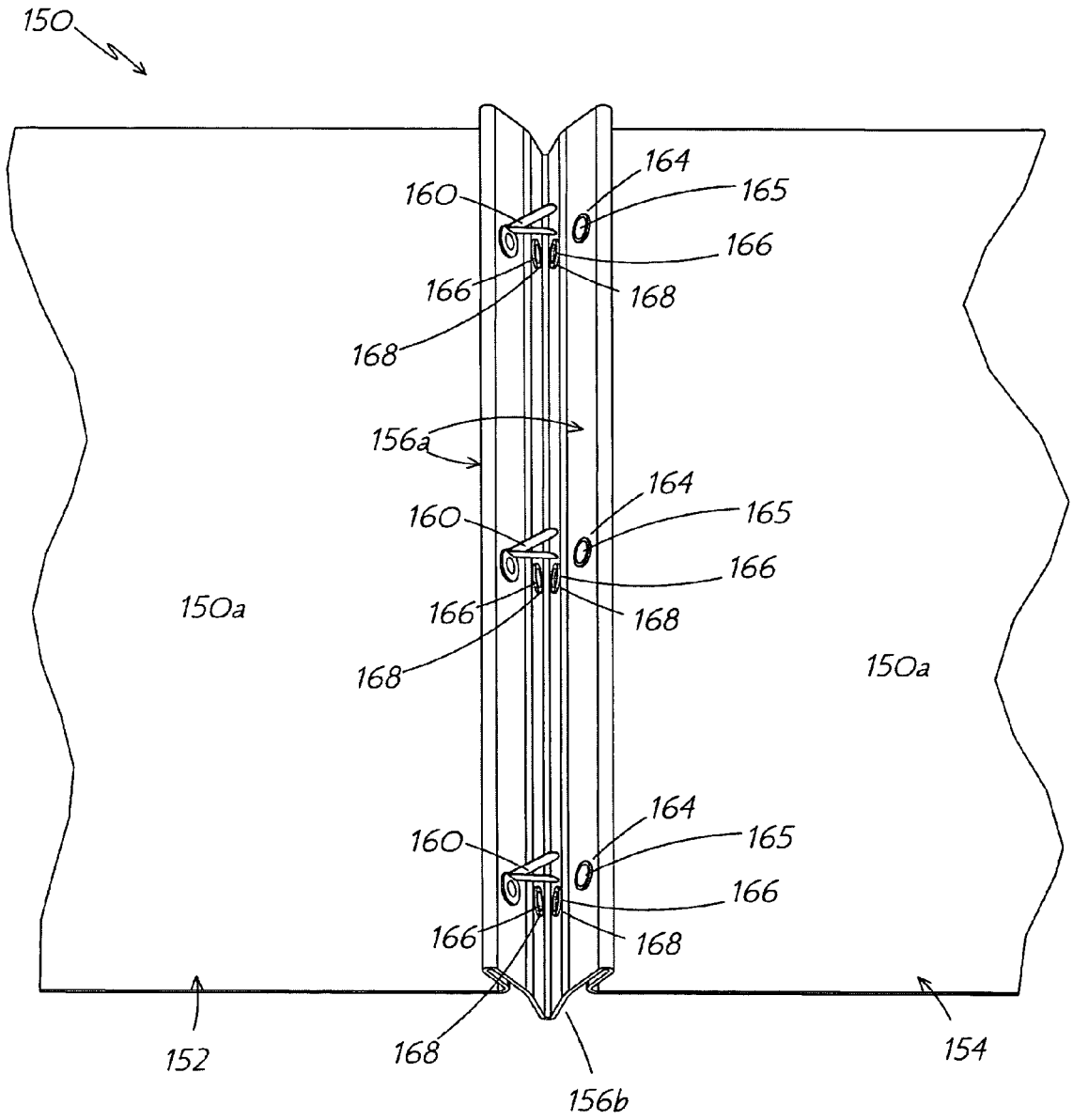
FIG. 7 is a partial front view of a second embodiment of the report cover in accordance with the present invention and showing the cover in an open position.
Figure 8:
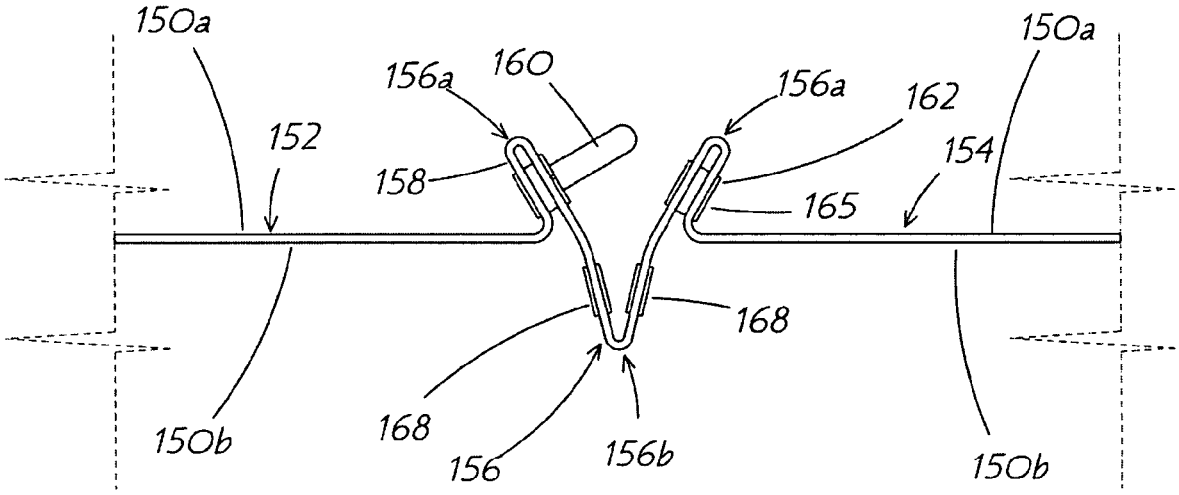
FIG. 8 is a partial bottom view of the report cover of FIG. 7, showing the detail of the exterior portion of the central spine.

A second embodiment of report cover is shown in FIGS. 7 & 8 and is generally indicated at 150. As with the first embodiment, cover 150 has a front sheet 152 and a back sheet 154 joined together at a spine 156. Cover 150 has an inner surface 150*a* and an outer surface 150*b*. An interior portion 156*a* of spine 156 extends outwardly from inner surface 150*a* of cover. An exterior portion 156*b* of spine 156 extends outwardly from outer surface 150*b* of cover. Exterior portion 156*b* of spine 156 preferably is formed from at least one fold of paper, but in this embodiment of the invention, each layer of the fold remains separated from the other. Each layer has a plurality of apertures 66 therein and each aperture 66 is circumscribed by a reinforcement 168. Interior portion 156*a* of spine is substantially identical to the interior portion 56*a* of the first embodiment and includes a first section 158 with prongs of fasteners 160 extending therefrom. Interior portion 156*a* further includes a second section 162 with a plurality of correspondingly positioned apertures 164 therein. As with the previous embodiment, apertures 164 may also be reinforced with a ring 165 as is common in the art. The configuration of the exterior portion 156*b* of spine 156 allows spine 156 to be opened wider allowing for easier insertion of pieces of paper (not shown) into cover through the increased clearance between the prongs of fasteners 160 and the apertures 164 which receive them.

Figure 9:
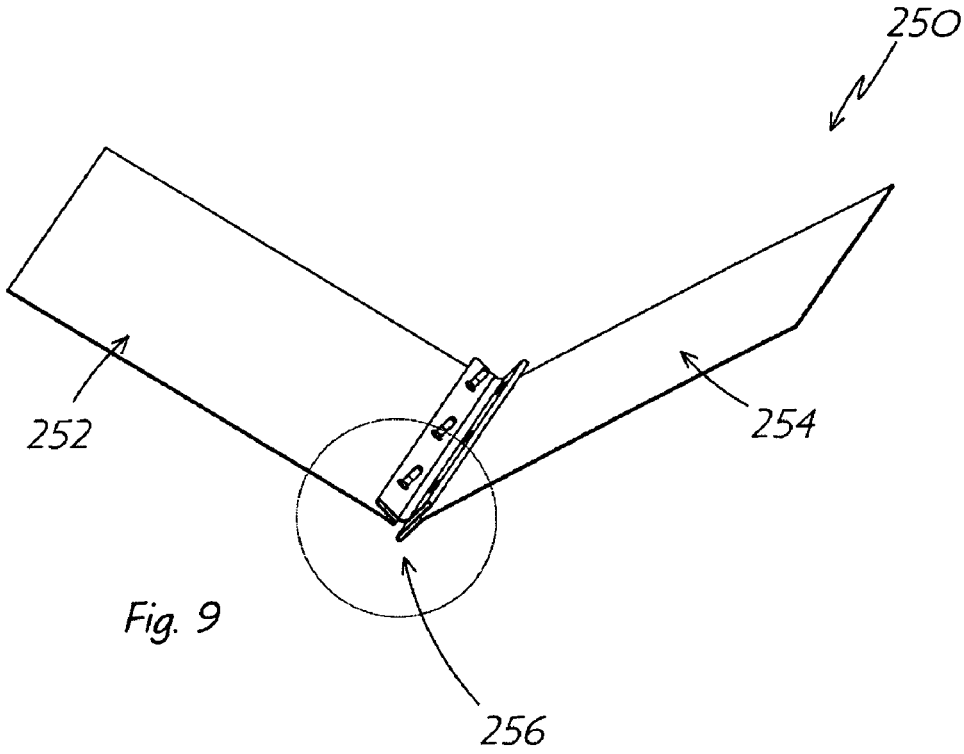
FIG. 9 is a perspective view of a third embodiment of the report cover in accordance with the present invention and showing a variation in the construction of the exterior portion of the spine.
Figure 10:
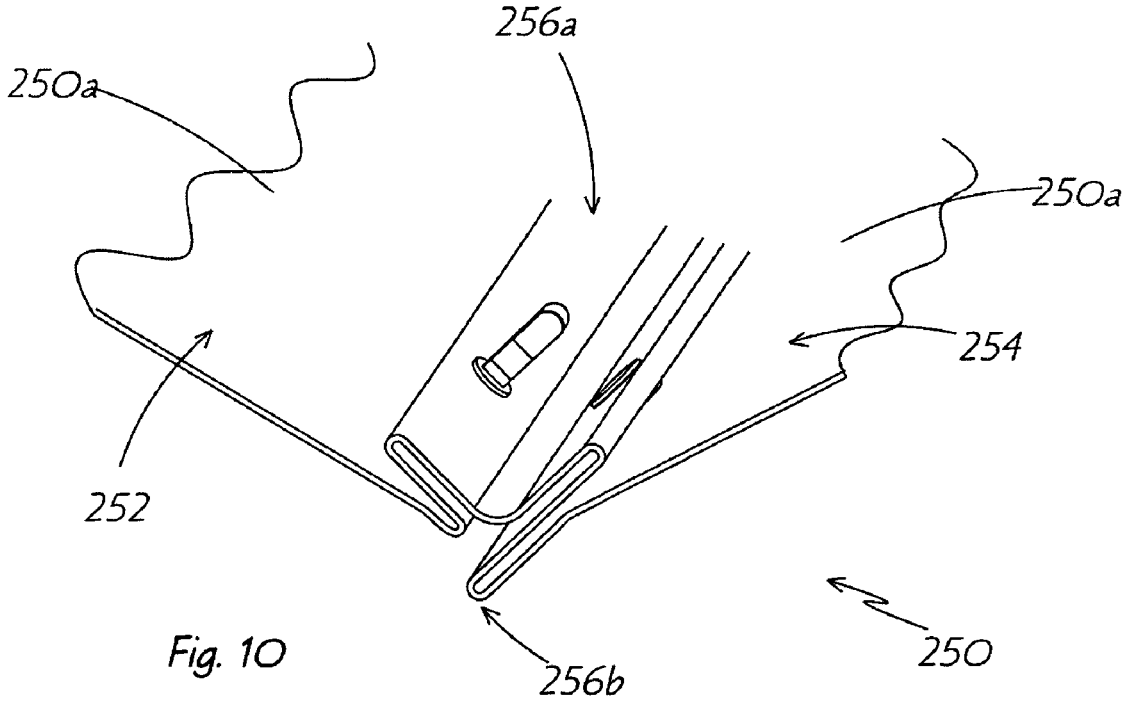
FIG. 10 is an enlarged partial perspective view of the spine of the report cover shown in FIG. 9.

A third embodiment of the report cover in accordance with the present invention is shown in FIGS. 9 and 10, and is generally indicated at 250. As with the previous embodiments, cover 250 has a front sheet 252, a back sheet 254, an inner surface 250*a* and an exterior surface (not shown). Front and back sheets 252, 254 are joined together at a spine 256. Spine 256 includes an interior portion 256*a* and an exterior portion 256*b*. Exterior portion 256*b* of spine 256 is formed as a fold in only the back sheet 254 of cover 250. It will, of course, be understood that the fold may alternatively be formed in only the front sheet 252 of cover 250. As with the previous embodiments, exterior portion 256*b* of spine 256 is provided with a plurality of reinforced apertures (not shown) which are adapted to engage the prongs of a ring binder.

A fourth embodiment of the report cover in accordance with the present invention is shown in FIGS. 11-15, and generally indicated at 350. As with the previous embodiments, cover 350 has a front sheet 352, a back sheet 354, an inner surface 350*a* and an exterior surface 350*b*. Front and back sheets 352, 354 are joined together at a spine 356. Spine 356 includes an interior portion 356*a* and an exterior portion 356*b*. Exterior portion 356*b* is formed from at least one fold of material and the two layers of material in the fold are not connected together. A plurality of slots (not shown) is formed at intervals along the apex 370 of exterior portion 356*b*. The slots lie substantially parallel to the longitudinal axis Y-Y' of the exterior portion 356*b* of spine 356 (FIGS. 11*a* & 11*b*). The position of the slots corresponds to the spacing between the prongs (not shown) of a three-ring binder. A reinforcing spring clip 368 is received within each slot. Clip 368 preferably is manufactured from either metal or plastic. Clip 368 includes a generally U-shaped tab portion 372 from which a pair of legs 374 extend. Tab portion 372 of each clip 368 further includes a hole 376 which is adapted to engage the prong of the three-ring binder. Tab portion has a longitudinal axis shown at X-X' in FIG. 10. Legs 374 extend from tab portion 372 substantially at right angles to the longitudinal axis X-X' of tab portion 372. Legs 374 are inserted through the slot in spine 356 and when inserted, legs 374 lie in proximity to inner surface 350*a* of cover 350. Tab portion 372 of reinforcing clip 368 has side walls 373 which include a pair of coplanar indentations 378 therein. When indentations 378 on side walls 373 of clip 368 engage in one of the slots in spine 356, then an end wall 380 (FIG. 10) of clip 368 lies substantially in abutting contact with exterior portion 356*b* of spine 356. When clip 368 is pulled outwardly in the direction of arrow "A" (FIG. 16), then end wall 380 lies remote from apex 370 of spine 356 and a hole 376 is formed between end wall 380 and apex 370. When in this position, the prong of a ring binder can be received through hole 376. End wall 380 of clip 368 is pushed inwardly into abutting contact with apex 370 of spine 356 when cover 350 is being used and is not being stored in the ring binder. The user inserts loose sheets of paper into cover 350 by passing the prongs 360 of the fasteners in interior portion 356*a* of spine 356 through holes punched in the paper and then into cooperating apertures 364 in interior portion 356*a* of spine 356.

Figure 16:
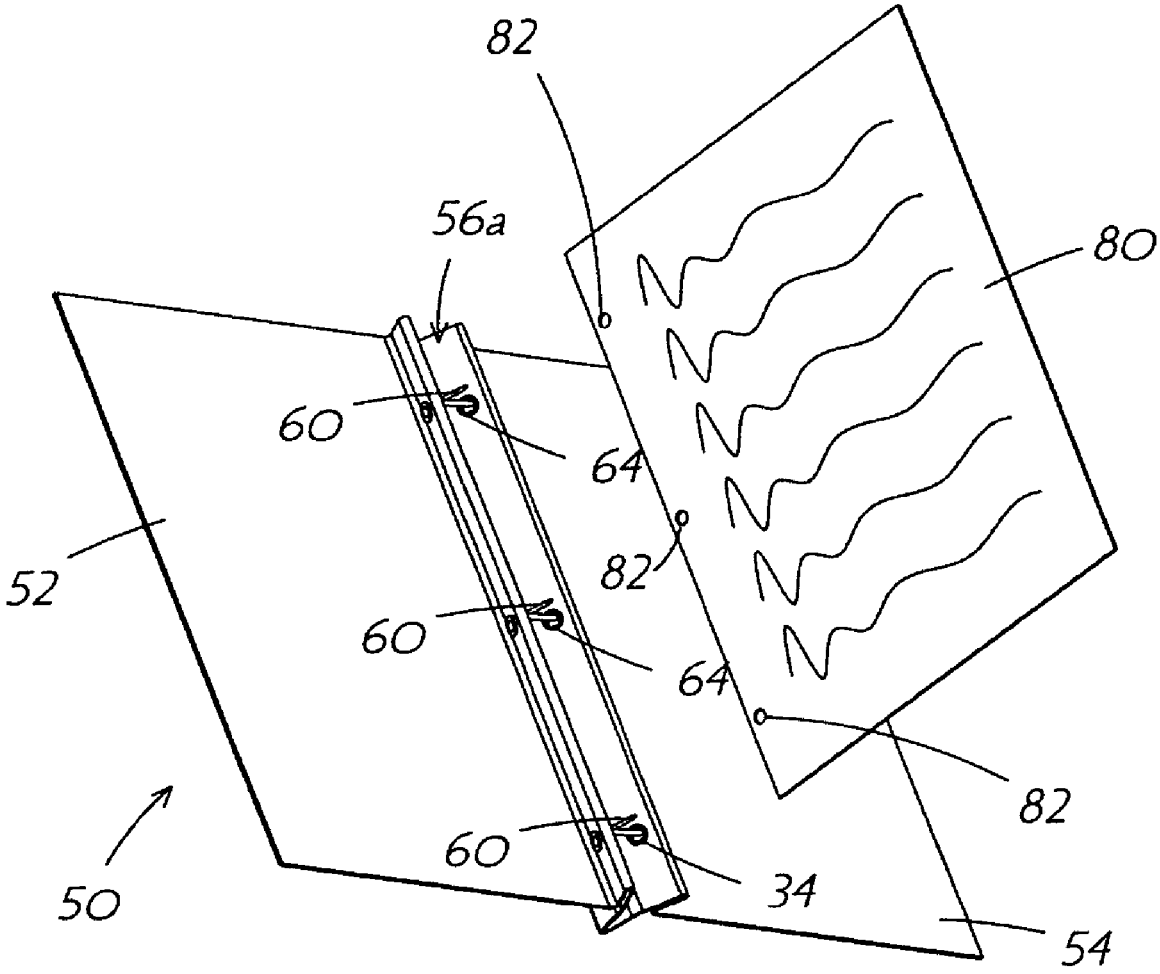
FIG. 16 is a perspective view of a report cover in a position to secure a plurality of sheets of paper therein.
Figure 17:
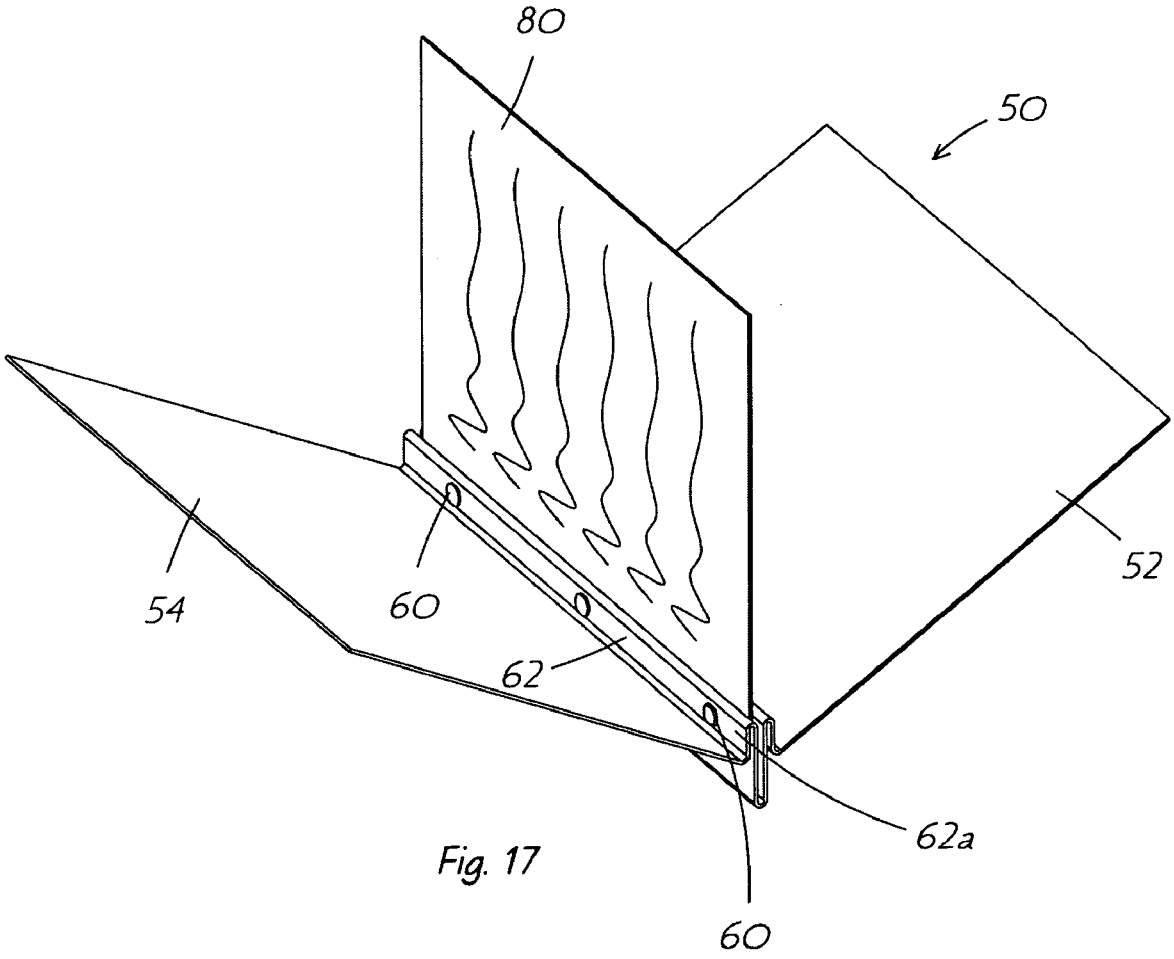
FIG. 17 is a perspective view of a report cover with the plurality of sheets of a paper secured therein.
Figure 18:
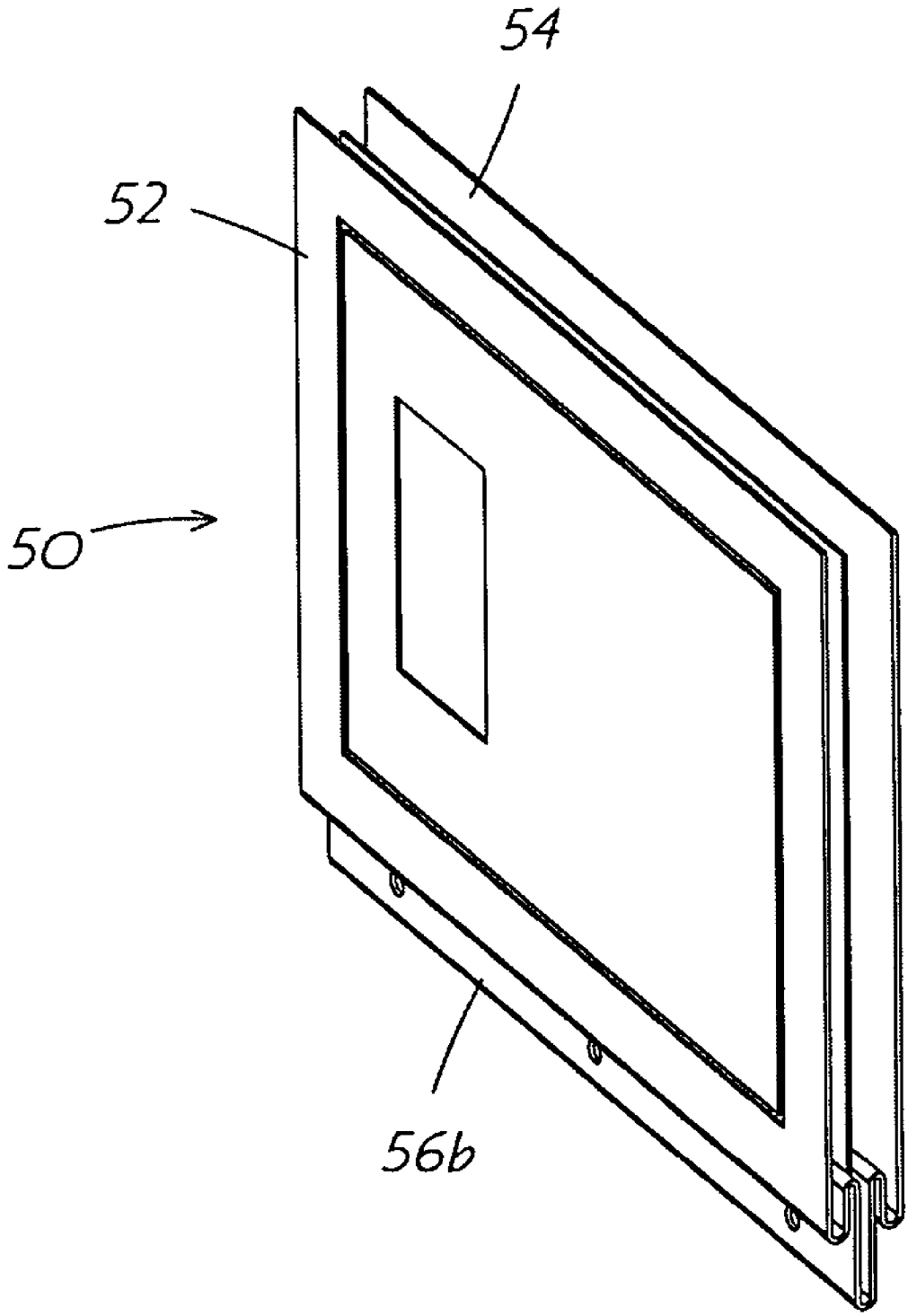
FIG. 18 is a perspective view of the report cover of FIG. 17 in a closed position.

Referring to FIGS. 16-18, the report cover of the present invention is used in the following manner. A plurality of sheets of paper 80 may be secured into cover 50 in the following manner. Each sheet of paper 80 preferably is provided with three holes 82. The user pushes the prongs of fastener 60 through holes 82 in the paper and then through apertures 64 in interior portion 56*a* of spine 56. The prongs of fasteners 60 are then separated from each other and pushed into abutting contact with the surface 62*a* (FIG. 17) of second section 62 of spine 56. At this point pages 80 are secured within report cover 50.

Figure 19:
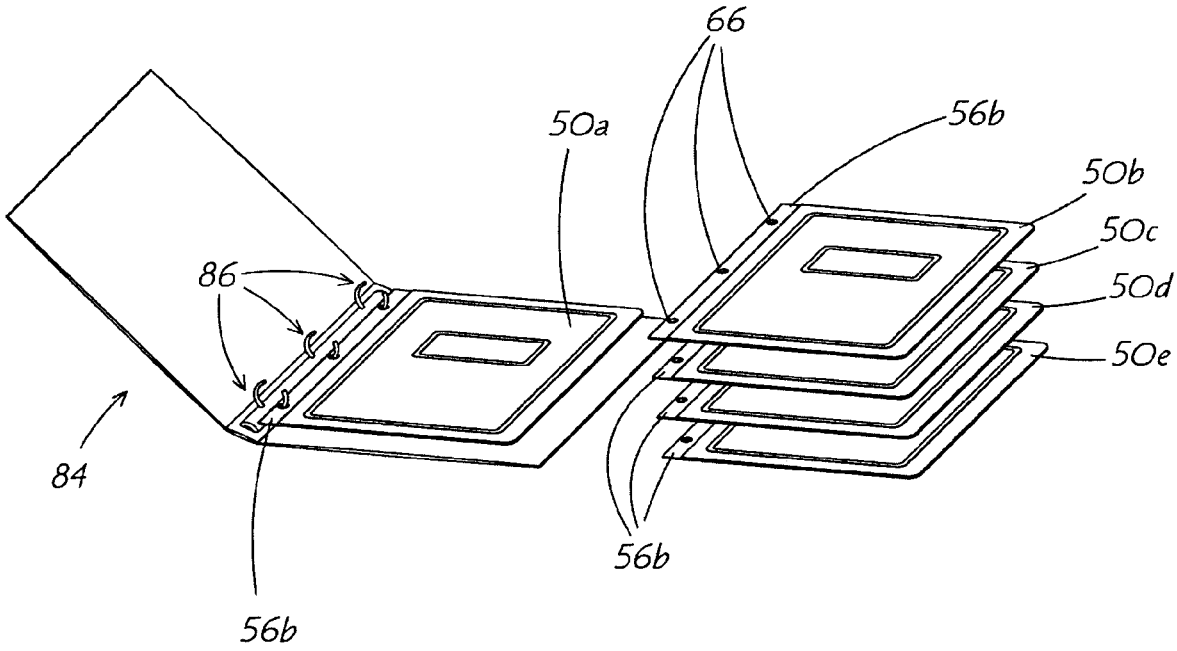
FIG. 19 is a perspective view of a plurality of report covers in accordance with the first embodiment of the invention being inserted into a ring binder for safekeeping.

With reference to FIG. 19, a plurality of report covers 50A, 50B, 50C, 50D and 50E may be secured into a three ring binder 84. It will be understood that report covers in accordance with the second and third embodiments of the invention may similarly be secured into a binder 84. Each cover 50A-E includes an interior portion (not shown) of a spine which allows a plurality of sheets of paper to be secured therein as described above. Each cover 50A-E also includes an exterior portion 56*b* of a spine which has a plurality of apertures 66 formed therein. The covers 50A-E are secured into three-ring binder 84 by inserting the binders prongs 86 through apertures 66 in the covers. The prongs 86 are then snapped shut in the customary manner. This allows several covers 50A-E to be transported within binder 84 and to be individually removable when needed.

Figure 11:
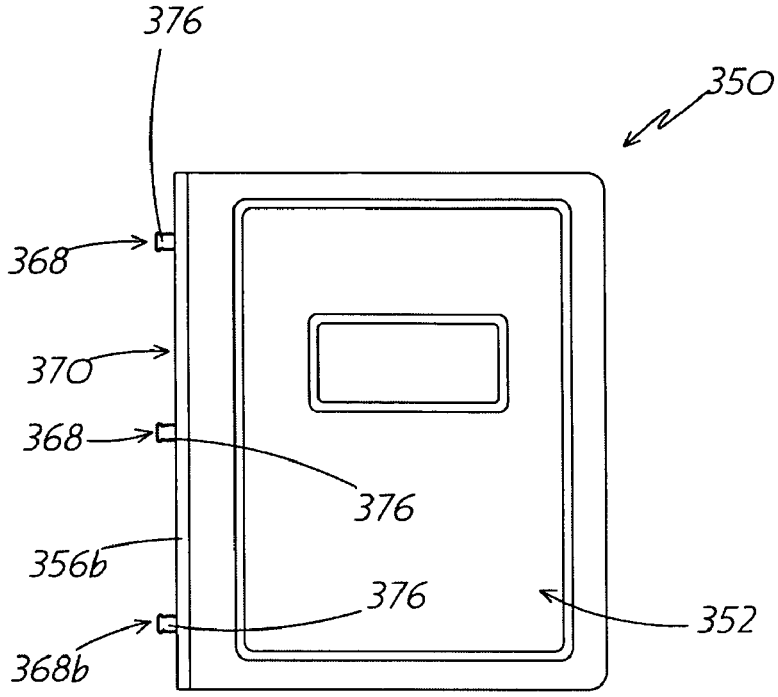
FIG. 11 is a front view of a third embodiment of the report cover in accordance with the present invention and showing a spring clip in an extended position for engagement in a ring binder.
Figure 12:
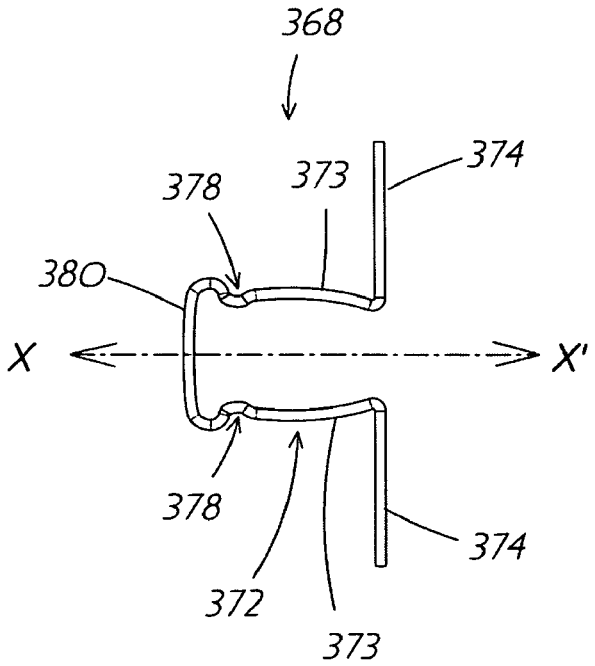
FIG. 12 is a side view of the spring clip that is inserted into the report cover of FIG. 11.
Figure 13A:
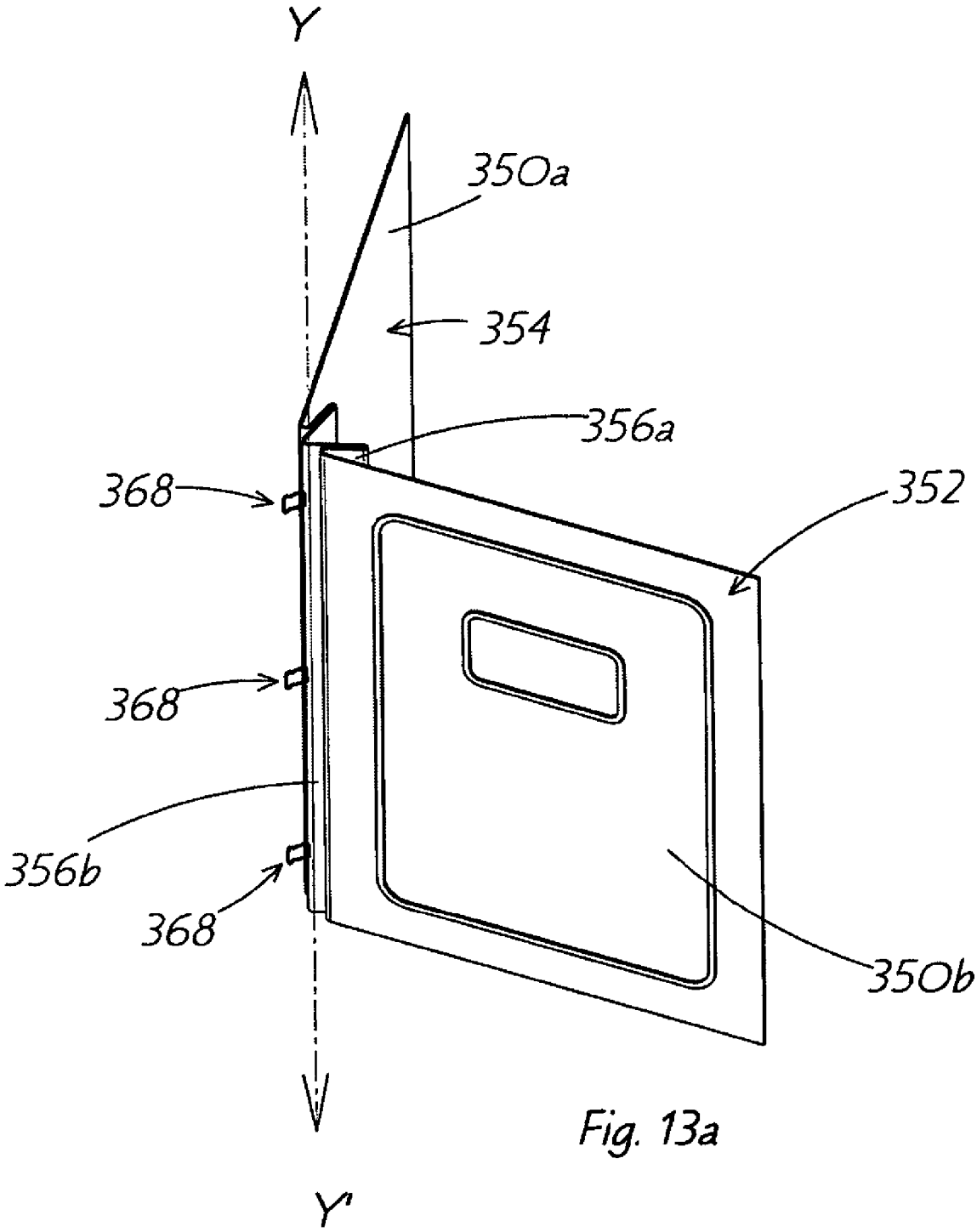
FIG. 13*a* is a perspective view of the exterior of the report cover showing the spring clips engaged in slots in the spine.
Figure 13B:
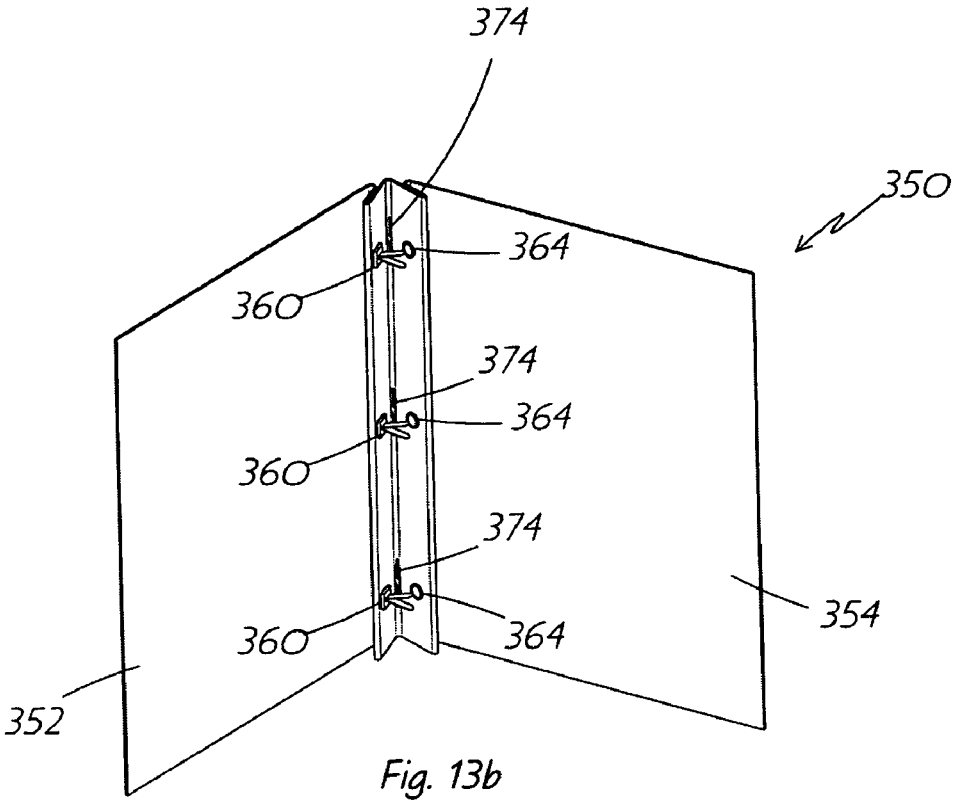
FIG. 13*b* is a perspective view of the interior of the report cover showing the spring clips engaged in slots in the spine.
Figure 15:
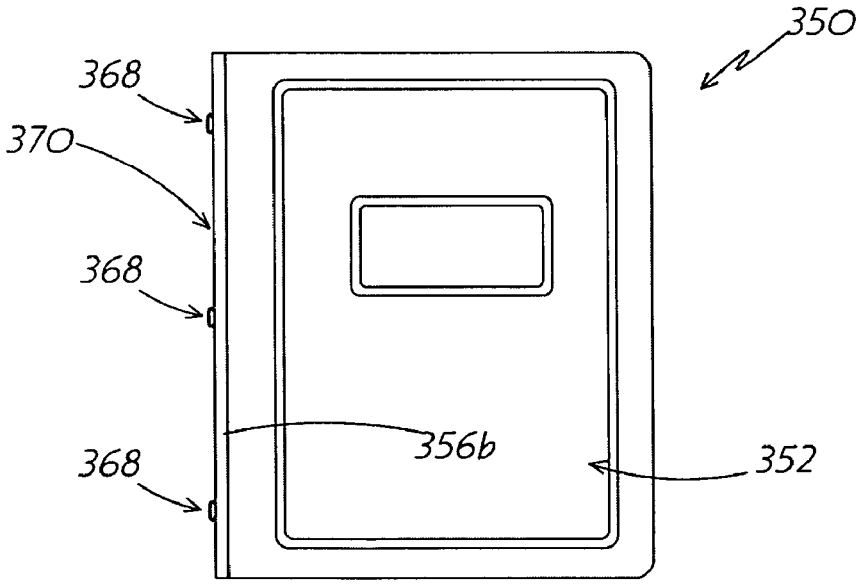
FIG. 15 is a front view of the report cover with the spring clip in a retracted position.
Figure 14:
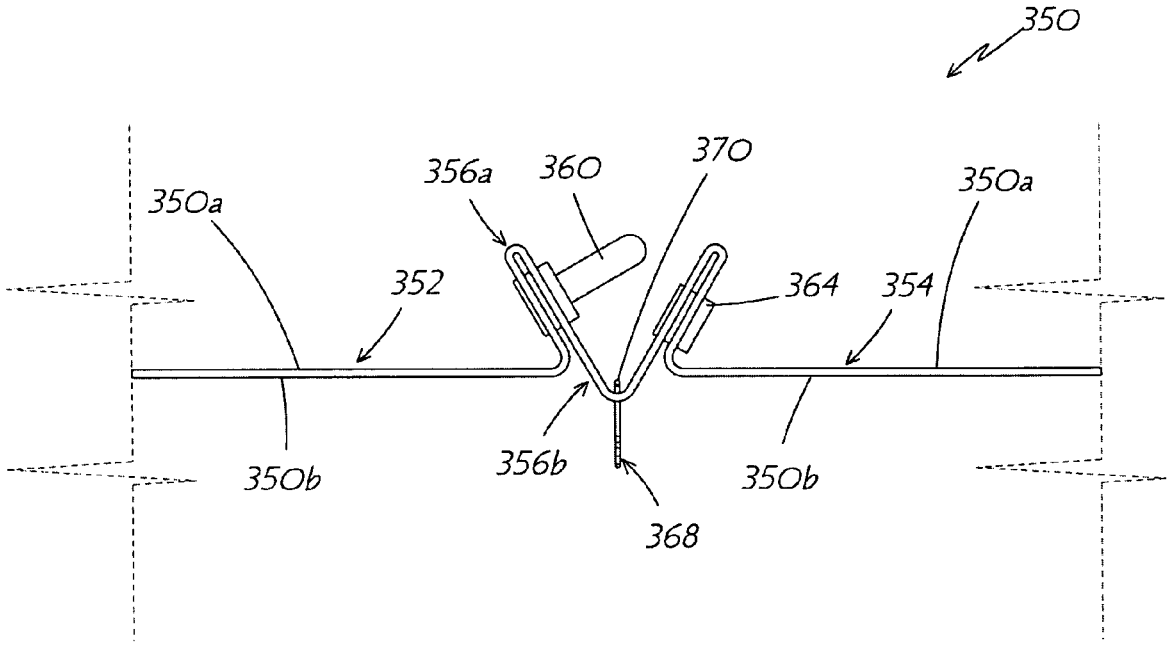
FIG. 14 is a partial bottom view of the opened report cover.
Figure 20:
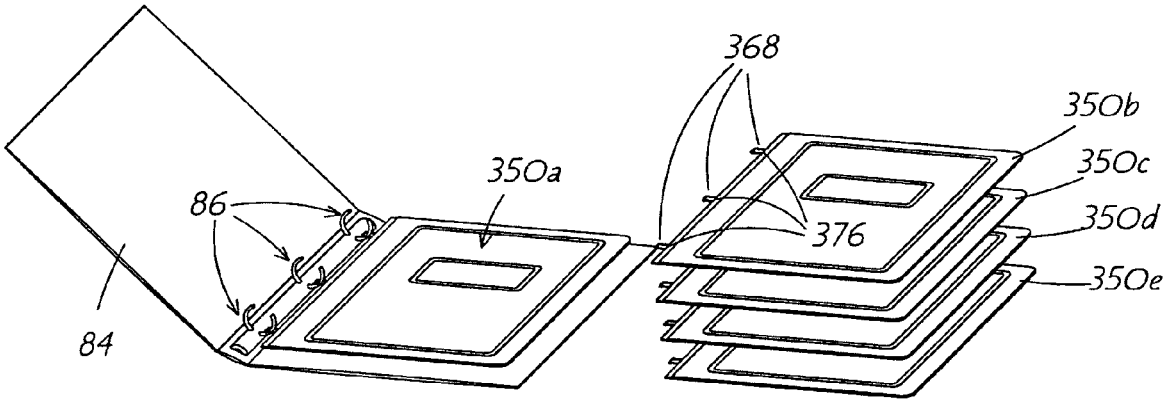
FIG. 20 is a perspective view of a plurality of report covers in accordance with the third embodiment of the invention being inserted into a ring binder for safekeeping.

Similarly, as is shown in FIG. 20, a plurality of report cover 350A through 350E may be inserted into three-ring binder 84. In this instance, spring clips 368 are pulled from the second position (as shown by clip 368*a* in FIG. 15) to the first position (shown by clips 368*b* in FIG. 11) so that hole a 376 is formed between apex 370 and end wall 380 (FIGS. 11 & 12). Prongs 86 of three-ring binder 84 are inserted through holes 376 in clips 368. Prongs 86 are then snapped shut to secure the plurality of report covers 350A through 350E into binder 84.

It will be understood that while the above description has been directed to report covers that have two-prong fasteners 60 in the interior portion 56*a* of spine 56, the report covers may have an alternative means for securing loose papers 80 into the cover. So, for example, the securing mechanism may be three-prong fasteners or a clamp-type fastener. Furthermore, while the report covers are shown to have three apertures 66 formed in the exterior portion 56*b* of the spine 56, it will be understood that the cover may include only two apertures or more than three apertures therein. Additionally, the exterior and interior portions of the spine are shown to be made from a fold in the material. The interior and exterior portions may alternatively be made from one or two layers of material connected into the report cover in any suitable manner. Furthermore, it will be understood that the distance to which the exterior portion of the spine extends outwardly from the outer surface of the cover may vary. That distance does, however, have to be sufficient for apertures to be formed in the exterior portion of the spine in positions which allow the apertures to engage the prongs of a ring binder.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A report cover for storing loose sheets of paper therein, each of said sheets including a plurality of spaced-apart punches holes therein; and wherein the cover comprises:

a front;

a back;

a spine connecting the front and back together; and thereby forming a receptacle having an interior surface and an exterior surface;

a pair of first tabs extending inwardly from the spine;

a first row of apertures provided on one of the first tabs, said first row of apertures being oriented substantially parallel to the spine;

a plurality of cooperating prongs provided on the other of the first tabs; and wherein the prongs are adapted to selectively be received through the punched holes in the paper and subsequently through the apertures to fixedly secure the paper within the receptacle;

at least one second tab extending outwardly away from the exterior surface of the receptacle;

a second row of apertures formed in the second tab; said second apertures being adapted to receive the rings of a ring binder therethrough and to thereby fixedly secure the cover within the ring binder.

2. The report cover as defined in claim 1, wherein the second tab is comprised of two layers of material.

3. The report cover as defined in claim 2, wherein the apertures in the second tab are formed in both layers of material and are disposed in co-aligned pairs; and wherein the cover further comprises a plurality of reinforcements selected from the group consisting of metal grommets, paper rings and fiber rings; each reinforcement circumscribing one of the co-aligned pairs of apertures, whereby the two layers of material are secured together by the reinforcements.

4. The report cover as defined in claim 1, wherein the second tab extends rearwardly for a distance beyond the spine when the cover is in the closed position.

5. The report cover as defined in claim 1, wherein each of the first and second tabs are integrally formed with one of the front, back and spine of the cover; and wherein the spine has a length and the first and second tabs are of substantially the same length as the spine.

6. The report cover as defined in claim 1, wherein each one of the apertures in the first row is substantially aligned with a respective one of the apertures in the second row.

7. The report cover as defined in claim 6, wherein each of the first and second rows of apertures includes three apertures and the spacing between the apertures within the first and second rows is substantially identical.

8. A report cover for securing a plurality of sheets of paper therein; said cover comprising:

a front page having an inner surface and an outer surface;

a back page having an inner surface and an outer surface;

a spine connecting the front page to the back page; the spine comprising:

an interior portion extending between the inner surfaces of the front and back pages;

an exterior portion extending outwardly from the outer surfaces of the front and back pages; said exterior portion being comprised of two layers of material formed into a fold which includes an apex;

a securing mechanism adapted to secure the sheets of paper to the interior portion of the spine;

a plurality of slots formed along the apex of the fold in the exterior portion of the spine; said slots lying substantially parallel to a longitudinal axis of the exterior portion of the spine;

a plurality of spring clips each being engageable in one of the slots and being adapted to engage the prongs of a ring binder; each spring clip including a substantially U-shaped tab portion and a pair of legs extending therefrom; said tab portion having a longitudinal axis and the legs of the clip extending outwardly away from the tab portion at substantially right angles to the longitudinal axis of the tab portion; said legs being receivable within one of the slots in the spine; and wherein the tab portion further includes a pair of opposing side walls each having an indentation formed therein, said indentations in the side walls being substantially coplanar with each other; and wherein the clip is movable from a first position, where an end wall thereof contacts the apex of the spine, and a second position where the end wall of the clip lies a spaced distance from the apex of the spine.

9. The report cover as defined in claim 8, wherein the indentations on the side walls of the clip engage in the slot when the clip is in the first position; and the indentations on the side walls of the clip lie remote from the slot when the clip is in the second position.

10. The report cover as defined in claim 9, wherein a hole is formed between the end wall of the clip and the apex of the exterior portion of the spine when the clip is in the second position; and wherein the hole is adapted to receive a prong of a ring binder therein.

11. The report cover as defined in claim 10, wherein the legs of the clip lie proximate an inner surface of the exterior portion of the spine and when the clip is in the first position, the legs lie a spaced distance from the inner surface of the exterior portion of the spine, and when the clip is in the second position, the legs lie in abutting contact with the inner surface of the exterior portion of the spine.

12. The report cover as defined in claim 8, wherein the spring clips are selected from the group consisting of one of metal and plastic.

13. In combination:

a ring binder having a front and a back connected together along a spine, and having a plurality of pairs of interlocking prongs extending outwardly away from an inner surface of the spine and being movable between an open position where the prongs are separated; and a closed position where the prongs are interlocked;

a plurality of report covers; each report cover having:

a front;

a back;

a spine disposed intermediate the front and the back and connecting the same together;

a first tab extending outwardly away from an interior surface of one of the front and the spine;

a second tab extending outwardly away from an interior surface of one of the back and the spine;

a securing mechanism disposed entirely between the interior surfaces of the front and back and operationally connecting the first and second tabs together; said securing mechanism being adapted to secure the sheets of paper between the first and second tabs;

a third tab extending outwardly away from an outer surface of one of the front and back; said third tab extending rearwardly beyond the spine;

a plurality of spaced apart second apertures formed in the third tab; said second apertures being adapted to receive the prongs of the ring binder therethrough; and wherein the plurality of the report covers may be individually selectively inserted into or removed from the ring binder.

14. A report cover for storing loose papers therein, wherein the report cover comprises:

a planar member having an interior surface and an exterior surface;

a first tab extending outwardly away from the interior surface;

a second tab extending outwardly away from the interior surface; the first and second tabs being connected together and said planar member being foldable about a foldline disposed between the first and second tabs;

a paper-retaining mechanism adapted to releasably secure the loose papers in the report cover; a first part of the securement mechanism being provided on the first tab and a second part of the securement mechanism being provided on the second tab; said first and second parts being operatively engageable with each other to retain the papers between the first and second tabs;

a third tab extending outwardly away from the exterior surface the planar member;

a securing mechanism provided on the third tab and being adapted to fixedly secure the third tab to a plurality of spaced apart prongs of a ring binder so as to retain the report cover therein.

15. The report cover as defined in claim 14, wherein the first tab is substantially U-shaped having a first leg and a second leg; and the second tab is substantially U-shaped having a first leg and a second leg; and wherein the second leg of the first tab is connected to the first leg of the second tab.

16. The report cover as defined in claim 15, wherein the third tab is substantially U-shaped having a first leg and a second leg; and wherein the first leg of the third tab is connected to the second leg of the second tab.

17. The report cover as defined in claim 16, wherein the first part of the paper-retaining mechanism connects the first and second legs of the first tab together.

18. The report cover as defined in claim 17, wherein the first part of the paper-retaining mechanism comprises a prong that extends outwardly from an interior portion of the second leg of the first tab toward an interior portion of the first leg of the second tab.

19. The report cover as defined in claim 18, wherein the second part of the paper-retaining mechanism connects the first and second legs of the second tab together.

20. The report cover as defined in claim 19, wherein each of the first and second legs of the second tab includes an aperture, and said apertures are aligned with one another and are circumscribed by a reinforcement that connects the first and second legs of the second tab together.

21. The report cover as defined in claim 20, wherein the securement mechanism provided on the third tabs comprises a plurality of spaced apart holes formed in each of the first and second legs of the third tab; and wherein said holes in the first and second legs of the third tab are aligned in pairs, with each pair of holes being circumscribed by a second reinforcement that connects the first and second legs of the third tab together.

* * * * *